United States Patent [19]

Yamaguchi

[11] Patent Number: 4,738,166

[45] Date of Patent: Apr. 19, 1988

[54] HELVE OF A HAMMER

[76] Inventor: Toshihiko Yamaguchi, 4-1, Uenoshibacho 4 cho, Sakai-shi, Osaka 593, Japan

[21] Appl. No.: 909,194

[22] Filed: Sep. 19, 1986

[30] Foreign Application Priority Data

Mar. 25, 1986 [JP] Japan ..... 61-44349[U]

[51] Int. Cl.[4] ..... B25D 1/00

[52] U.S. Cl. ..... 81/22

[58] Field of Search ..... 81/20, 22, 489, 177.1, 81/492

[56] References Cited

U.S. PATENT DOCUMENTS

| | | | |
|---|---|---|---|
| 1,581,647 | 4/1926 | Layton | 81/489 |
| 2,467,284 | 4/1949 | Williams | 81/20 X |
| 2,603,260 | 7/1952 | Floren | 81/22 |
| 2,884,969 | 5/1959 | Lay | 81/22 |
| 2,960,133 | 11/1960 | Shepherd, Jr. | 81/22 |
| 3,089,525 | 5/1963 | Palmer | 81/22 |
| 3,613,753 | 10/1971 | Wolf | 81/20 |
| 4,548,248 | 10/1985 | Riemann | 81/22 |

FOREIGN PATENT DOCUMENTS

| | | | |
|---|---|---|---|
| 74760 | 2/1949 | Norway | 81/22 |

*Primary Examiner*—Frederick R. Schmidt
*Assistant Examiner*—Bradley I. Vaught
*Attorney, Agent, or Firm*—Wenderoth, Lind & Ponack

[57] ABSTRACT

A hammer having a helve which includes a core attached at one end to a hammer head and a grip surrounding the core, the grip having a pair of axially extending passages therethrough, the passages being located in diametrically opposed relation to each other along a direction which is parallel to the striking direction of the hammer head. The axially extending passages absorb shock by allowing the grip to deform when the hammer head strikes an object which allows the user to maintain a tight grip of the hammer.

12 Claims, 2 Drawing Sheets

HELVE OF A HAMMER

BACKGROUND OF THE INVENTION (1) Field of the Invention

This invention relates to a helve of a hammer which is used for striking nails or other objects, and, in particular, to a grip which covers the gripping part of the above-mentioned helve of the hammer.

(2) Prior Art

In the past, various kinds of expedients have been resorted to in an effort to prevent the grip of the helve of a hammer from sliding out of the user's hand at the time of striking an object with the hammer. For example, it has been proposed to provide a jagged and rough surface on the outer side of the grip such as providing a coating of a gummy or tacky elastic material on the grip but such an approach is not effective in preventing shock to the hand at the time of striking with the hammer.

When using a hammer it is necessary to grip the helve with a very strong force at the time of striking an object. However, when the grip is covered with a gummy or tacky elastic material it becomes unstable when the head of the hammer strikes an object if the elastic material is too soft. On the other hand, it has been found that a coating of gummy elastic material having a relatively high-degree of hardness is poor in shock-absorbing power which results in injury to the hand due to repeated shock from striking objects with the hammer. Furthermore, such a coating having a high-degree of hardness makes the hammer difficult to handle due to the poor shock absorbing qualities of the grip.

It is an object of the present invention to provide a helve of a hammer which does not suffer from the disadvantages mentioned above.

SUMMARY OF THE INVENTION

The present invention provides an improved helve of a hammer which is easy to grip and provides good shock absorbing qualities. The helve of the hammer of the present invention includes axial passages which extend along the length of the grip of the hammer, the passages providing reduced shock to the hand when the hammer strikes an object. The helve of the hammer of the present invention comprises a core having the frontal part thereof fitted to the head of the hammer and a gripping portion covering the core with the gripping portion being a gummy elastic material having the axially extending passages therein.

BRIEF DESCRIPTION OF THE DRAWINGS

The present invention will be described with reference to the accompanying drawings, in which.

DETAILED DESCRIPTION OF THE PREFERRED EMBODIMENT

Figure 3:
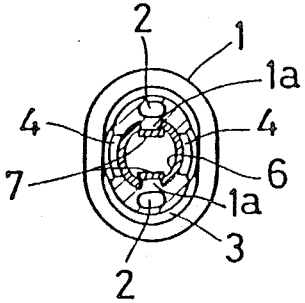
FIG. 3 is a cross-sectional view taken along the line A—A shown in FIG. 1.
Figure 2:
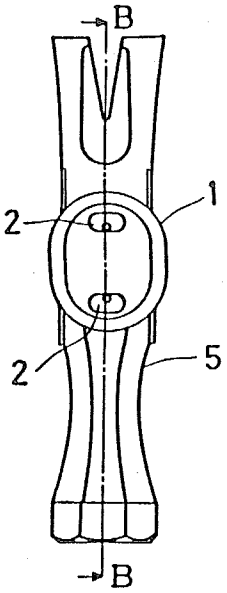
FIG. 2 is an end view of the hammer shown in FIG. 1.

The grip 1 of the present invention is a gummy elastic material, for example, a synthetic resin or rubber having a relatively high-degree of hardness. The grip 1 is fitted over a rear part of a core 6 of the helve of the hammer. The core 6 comprises a metallic hollow tube which is attached at a front end thereof to a hammer head 5. The grip 1 has a plurality of axially extending passages or holes 2 which extend along the longitudinal direction of the helve of the hammer. As shown in FIGS. 2 and 3, the passages 2 may consist of an upper and lower passage which are diametrically opposed to each other. Also, it can be seen from FIG. 4 that the axially extending passages 2 taper along the length thereof with the portions of the passages 2 closer to the hammer head becoming more narrow.

Figure 1:
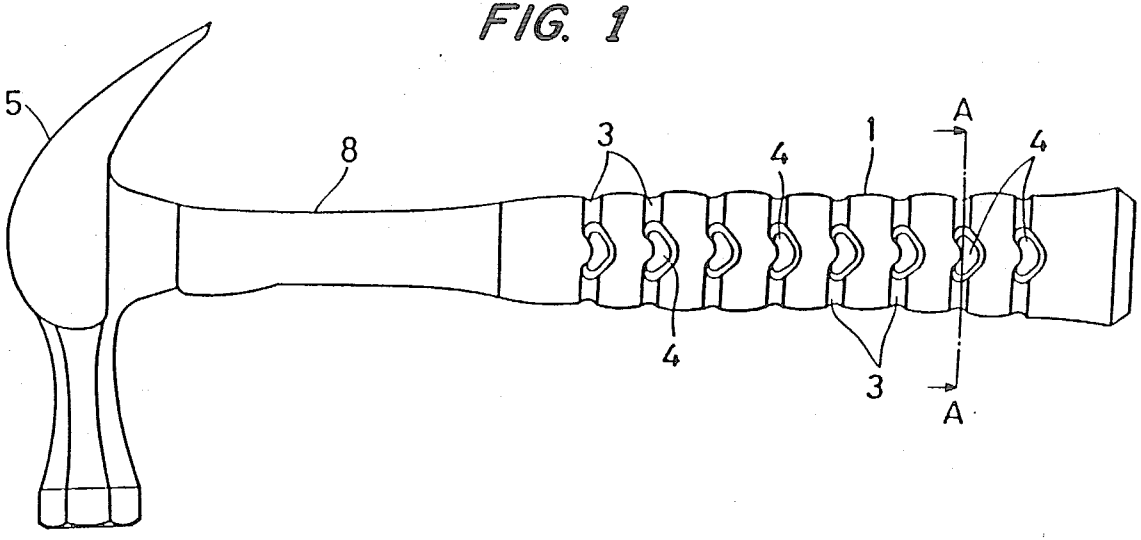
FIG. 1 is a side view of the hammer having the grip according to the present invention thereon.

Along the surface of the grip 1 there are provided a plurality of concave grooves 3 which extend circumferentially around the grip portion 1 at spaced intervals along the longitudinal length of the helve. A plurality of openings 4 extend radially inward from the surface of the grip 1 and serve to prevent the grip from slipping from a user's hand due to slight sweatiness of the hand when using the hammer. As can be seen from FIG. 1, the openings 4 are provided at spaced intervals which coincide with the circumferentially extending grooves 3.

The core 6 of the helve includes recessed portions 7 which form engaging grooves along the core 6 for receiving connecting portions 1*a*, 5*a* and 8*a* of the grip 1, the head of the hammer 5, and an intermediate portion of the helve 8, respectively. The intermediate portion 8 may be formed of a material having a different color than the grip 1. The intermediate portion 8 can be formed out of a wear-resisting material, for example, polyurethane resin which serves to protect the helve of the hammer when objects deflect off the hammer head 5 or when the hammer head 5 misses its target and the intermediate portion 8 comes in contact with the object intended to be hit or another object.

Figure 4:
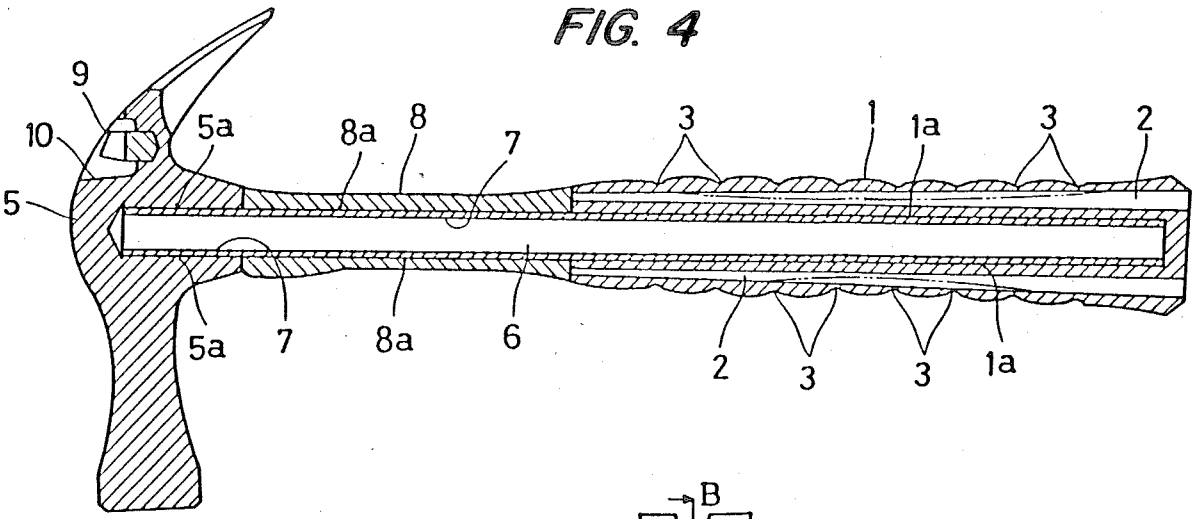
FIG. 4 is a longitudinal sectional view taken along the line B—B shown in FIG. 2.

The engaging grooves formed by the recessed portions 7 in the core 6 of the helve anchor the parts 1*a*, 5*a* and 8*a* of the grip 1, the head of the hammer 5 and the intermediate portion 8, respectively, to thereby prevent rotation of these parts with respect to the core 6 of the helve. The engaging grooves are diametrically opposed to each other and intersect a center line of the hammer head extending from the striking portion of the hammer head 5 to the claw portion thereof, the center line being parallel to the line B—B shown in FIG. 2. The grip is made thicker above and below the engaging grooves as shown in FIGS. 3 and 4 with the axially extending passages extending longitudinally through these thicker portions of the grip 1. Thus, the passages 2 are provided in the portion of the helve which absorbs the greatest impact forces. Also, the provision of the thicker parts of the grip 1 enables the passages to be more easily drilled or bored in the elastic grip material.

The hammer head 5 includes a nail-holding part 9 which can be used to set a nail into a surface into which the nail is to be driven. The nail-holding part 9 consists of a pair of pinching pieces which hold a nail by its trunk part with the head of the nail held against a striking surface 10 of the hammer head 5. Thus, a nail can be placed in the pinching pieces 9 with the trunk part or shank of the nail extending away from the striking wall 10 and the nail is set in a surface by striking the nail head against the striking wall 10.

From the description of the invention set forth above, it will be evident that when the manner of the present invention strikes an object, the impact force is absorbed by the deformation-absorbing property of the axial passages in the elastic grip after which the same force serves to restore the axial passages to their original sizes with the result that the impact force has no effect on the palm of a user's hand.

The deformation-absorbing property of the axial passages allows proper gripping of the hammer when striking an object and the palm is pressed tightly to the surface of the grip due to the restoring force of the deformed axial passages so that the helve of the hammer remains closely fit with the palm to promote the grasping power of the hand without causing it to relax.

The helve of the present invention advantageously places the axial passages in the grip at positions along the direction of the striking force of the hammer and also along the direction of transmission of the shock vibration which occurs after striking an object. Since the pair of axial passages are provided in diametrically opposed relation to each other and along the line of grasping power and impulsive force at the time of striking with the hammer, the grasping power and impulsive force can be absorbed more effectively.

The following advantages are obtained when using a hammer according to the present invention. By utilizing the deformation-absorbing property of the axial passages bored along the longitudinal direction within the grip which is formed by covering the helve of a hammer with gummy elastic material, the grasping power and impulsive force acting on the gripping part at the time of striking the nail head or other object while grasping the helve part of the hammer are prevented from impacting directly on the palm of the hand and due to the prevention of shock vibration to the hand at the time of striking, the user is able to maintain a close fit of the grip in the user's palm and a tight grasp of the grip can be maintained. Therefore, the hammer constructed according to the present invention provides a safer working operation since the user can maintain a tight grip and thus maintain better control over the hammer without the fear of relaxing one's grasp on the helve due to otherwise painful vibration which occurs upon striking an object. Moreover, by providing the axial passages in a diametrically opposed relation to each other along the direction of force exerted by the hammer when striking an object, the propagating shock wave which results upon hitting an object is effectively absorbed by deformation of the grip material around the axial passages and thus a user is able to maintain a strong grip of the hammer without injury to the hand.

Although a preferred embodiment of the invention has been specifically illustrated and the described herein, it is to be understood that minor variations may be made without departing from the spirit and scope of the invention as defined in the claims.

I claim:

1. A hammer comprising a head of the hammer and a helve, the helve including a core comprising a metallic tube extending in a longitudinal direction and attached to the hammer head and a grip disposed on a gripping portion of the core, the grip comprising a gummy elastic material having means for absorbing shock transmitted to said grip due to impact of said hammer head, said shock absorbing means comprising a plurality of axially extending passages in said gummy elastic material, said passages extending along said longitudinal direction and through a rear end surface of said grip facing away from said hammer head to allow air to pass freely into and out of said passages.

2. The hammer of claim 1, wherein said plurality of axially extending passages comprise two diametrically opposed passages, said passages being located on opposite sides of the core in a direction which is parallel to the striking direction of the hammer head.

3. The hammer of claim 1, wherein said core includes recessed portions and said grip includes connecting portions fitted in said recessed portions of said core to prevent rotation of said grip.

4. The hammer of claim 1, wherein said grip is thicker on diametrically opposed sides of said core in a direction which is parallel to the striking direction of said hammer head and said plurality of axial passages comprise a tapered axial passage provided in each thicker portion of said grip with the axial passages becoming narrower at each point therealong in the direction towards said hammer head.

5. The hammer of claim 1, wherein a plurality of axially spaced apart, circumferentially extending grooves are provided along said grip, said grooves extending completely around an outer periphery of said grip.

6. The hammer of claim 5, wherein a plurality of radially inwardly extending openings are provided in said grip, said openings being provided at axially spaced intervals which coincide with said grooves and extending from said outer periphery of said grip radially inwardly to a greater extent than said grooves.

7. A hammer comprising a head of the hammer and a helve, the helve including a core comprising a metallic tube extending in a longitudinal direction and attached to the hammer head and a grip disposed on a gripping portion of the core, the grip being a gummy elastic material and having means for absorbing shock transmitted to said grip due to impact of said hammer head, said shock absorbing means comprising a plurality of axially extending passages through said gummy elastic material, said passages extending along said longitudinal direction, said plurality of axially extending passages comprising two diametrically opposed passages, said passages being located on opposite sides of the core in a direction which is parallel to the striking direction of the hammer head, said passages extending through a rear end surface of said grip to allow air to pass freely into and out of said passages, said core having longitudinally extending recessed portions therein and said grip including longitudinally extending connecting portions fitted in said recessed portions of said core to prevent rotation of said grip, said grip being thicker on diametrically opposed sides of said core in a direction which is parallel to the striking direction of said hammer head and said two diametrically opposed passages comprise a tapered axial passage provided in each thicker portion of said grip with the axial passages becoming narrower at each point therealong in the direction towards said hammer head, said grip further including a plurality of axially spaced apart, circumferentially extending grooves therein and a plurality of radially inwardly extending openings provided at axially spaced intervals which coincide with said grooves.

8. A hammer comprising a head of the hammer and a helve, the helve including a core extending in a longitudinal direction and attached to the hammer head and a grip disposed on a gripping portion of the core, the grip comprising a gummy elastic material having means for absorbing shock integrally formed therewith, said shock absorbing means comprising a plurality of axially extending passages in said gummy elastic material, said passages extending along said longitudinal direction, said plurality of axially extending passages comprising at least two diametrically opposed passages, said passages being located on opposite sides of the core in a direction which is parallel to the striking direction of the hammer head, said passages extending through a rear end surface of said grip facing away from said hammer head to allow air to pass freely into and out of said passages.

9. The hammer of claim 8, wherein said core is a metallic tube which includes recessed portions and said grip includes connecting portions fitted in said recessed portions of said core to prevent rotation of said grip.

10. The hammer of claim 8, wherein said grip is thicker on diametrically opposed sides of said core in a direction which is parallel to the striking direction of said hammer head and said two diametrically opposed passages comprise a tapered axial passage provided in each thicker portion of said grip with the axial passages becoming narrower at each point therealong in the direction towards said hammer head.

11. The hammer of claim 8, wherein a plurality of axilaly spaced apart, circumferentially extending grooves are provided along said grip, said grooves extending completely around the periphery of said grip.

12. The hammer of claim 11, wherein a plurality of radially inwardly extending openings are provided on said grip, said openings being provided at axially spaced intervals which coincide with said grooves and extending from said outer periphery of said grip to an outer periphery of said core.

* * * * *